US007467529B1

(12) United States Patent
Lai et al.

(10) Patent No.: US 7,467,529 B1
(45) Date of Patent: Dec. 23, 2008

(54) LOCKABLE LUGGAGE STRAP ASSEMBLY

(75) Inventors: Eric Lai, Tai Po (HK); Karl Lai, Tai Po (HK)

(73) Assignee: The Sun Lock Company Ltd., Tuen Mun, NY (HK)

( * ) Notice: Subject to any disclaimer, the term of this patent is extended or adjusted under 35 U.S.C. 154(b) by 0 days.

(21) Appl. No.: 11/709,647

(22) Filed: Feb. 21, 2007

Related U.S. Application Data

(60) Provisional application No. 60/775,612, filed on Feb. 22, 2006.

(51) Int. Cl.
*E05B 73/00* (2006.01)

(52) U.S. Cl. ..... 70/18; 70/21; 70/58; 70/69; 70/284; 70/285; 70/DIG. 9

(58) Field of Classification Search ..... 70/14, 70/18, 21, 25, DIG. 9, 284, 285, 312, DIG. 63, 70/DIG. 71, 30, 49, 58, 68–72, 74
See application file for complete search history.

(56) References Cited

U.S. PATENT DOCUMENTS

| | | | | |
|---|---|---|---|---|
| 5,345,798 | A * | 9/1994 | Nakai | 70/284 |
| 6,016,675 | A * | 1/2000 | Te | 70/312 |
| 6,189,348 | B1 * | 2/2001 | Huang | 70/18 |
| 6,883,354 | B1 * | 4/2005 | Yu | 70/18 |
| 6,912,879 | B1 * | 7/2005 | Yu | 70/58 |
| 6,912,880 | B2 * | 7/2005 | Ling et al. | 70/71 |
| 7,032,415 | B2 * | 4/2006 | Young | 70/18 |
| 7,104,095 | B1 * | 9/2006 | Lin | 70/58 |
| 2003/0164009 | A1 * | 9/2003 | Levi | 70/18 |
| 2005/0055810 | A1 * | 3/2005 | Loughlin et al. | 24/615 |
| 2005/0092039 | A1 * | 5/2005 | Mak et al. | 70/58 |
| 2006/0081022 | A1 * | 4/2006 | Yu | 70/58 |
| 2006/0207301 | A1 * | 9/2006 | Yu | 70/58 |
| 2006/0207302 | A1 * | 9/2006 | Yu | 70/58 |
| 2006/0272368 | A1 * | 12/2006 | Yu | 70/58 |

* cited by examiner

*Primary Examiner*—Lloyd A Gall
(74) *Attorney, Agent, or Firm*—Melvin I. Stoltz

(57) ABSTRACT

By providing two separate and independent locking systems, each of which enable the mating components thereof to be released and/or lockingly engaged by employing either a key controlled portion or a combination controlled portion, with each component mounted to opposed ends of a continuous strap or belt member, an effective, easily produced lockable luggage strap assembly is achieved that is formed in a single assembly. In the preferred, a single housing is employed in which all of the required components are contained, with the housing being securely affixed to one end of an elongated, continuous strap member. In addition, the opposed end of the strap is securely affixed to a slider member which is constructed for mating, sliding and locking interengagement with the housing. In this way, the slider member is securely lockingly interengaged with the housing, providing secure, locked mounted engagement of the strap assembly with the luggage or desired product.

14 Claims, 10 Drawing Sheets

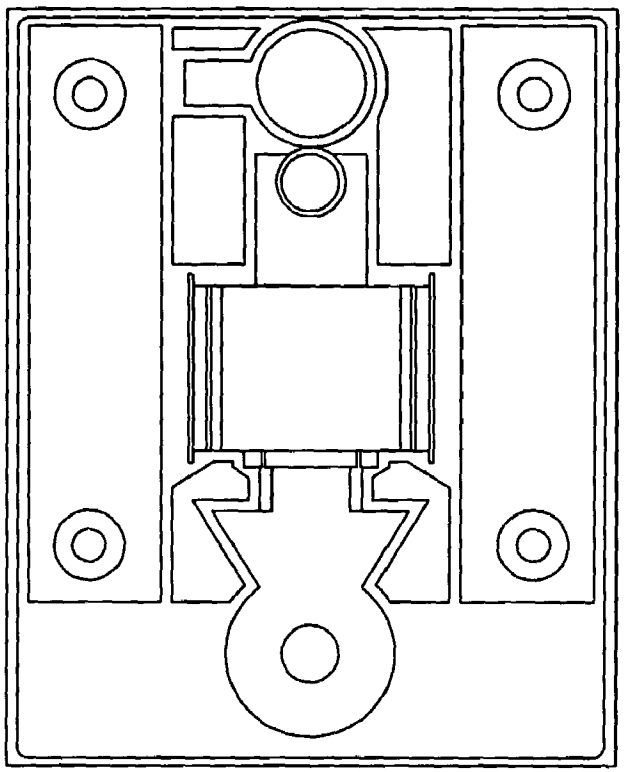
FIG. 22C
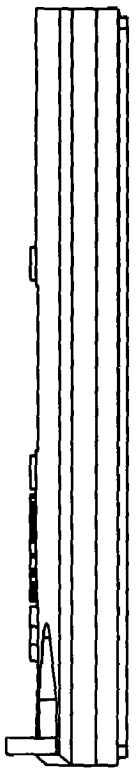
FIG. 22B
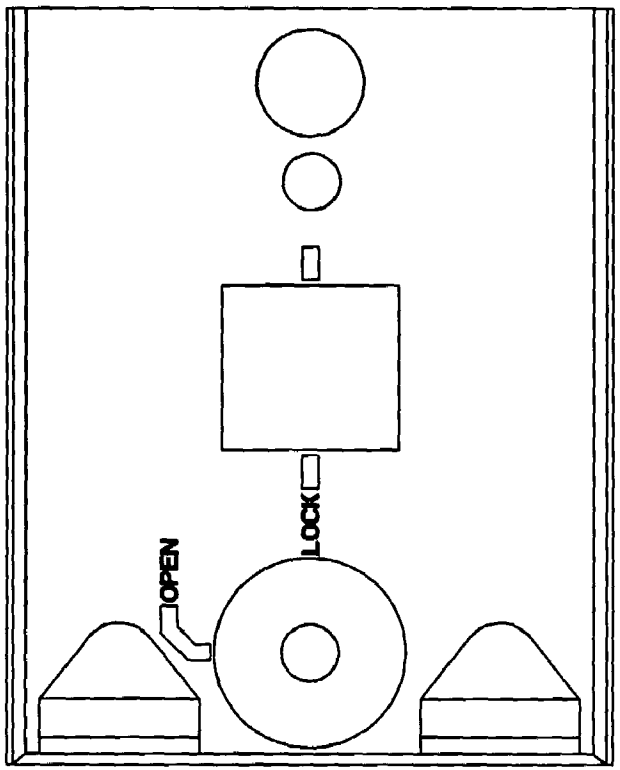
FIG. 22
FIG. 22A

FIG. 23C
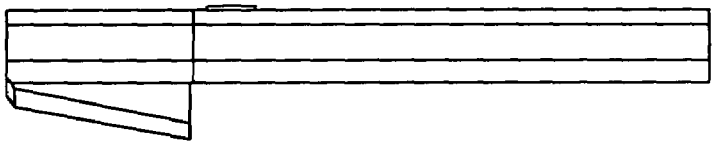
FIG. 23B
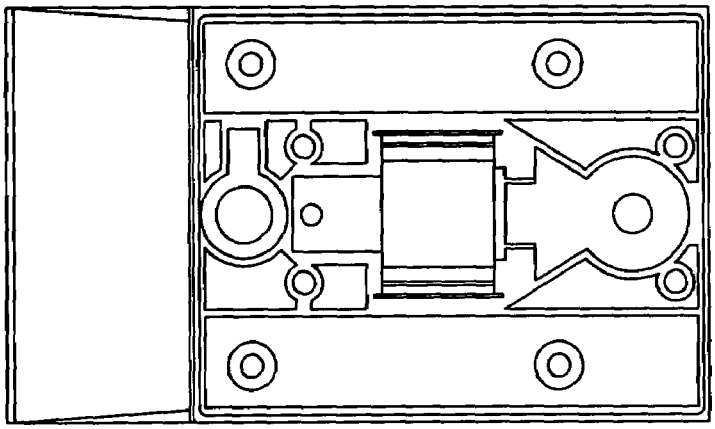
FIG. 23D
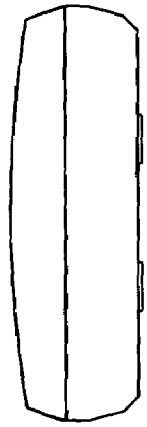
FIG. 23
FIG. 23A
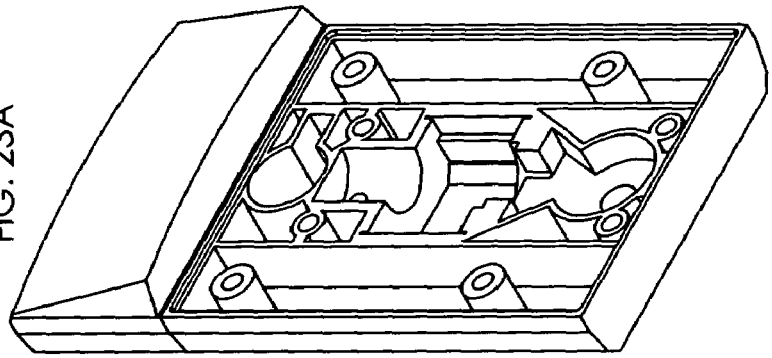

J1

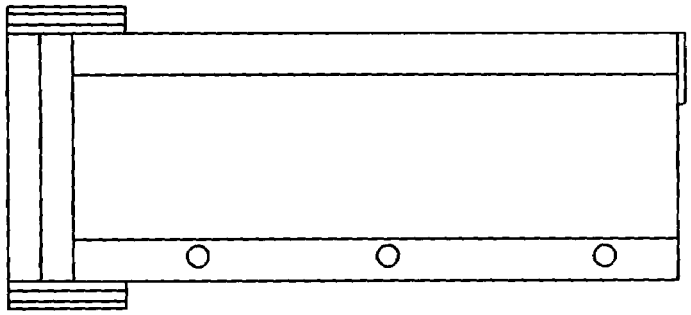
FIG. 25D
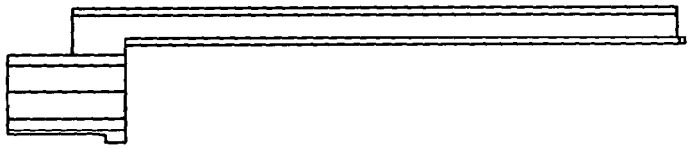
FIG. 25C
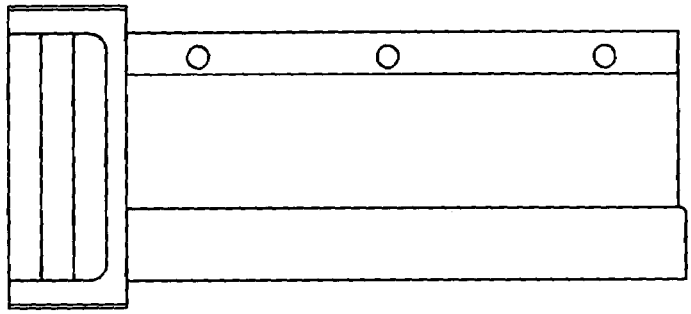
FIG. 25B
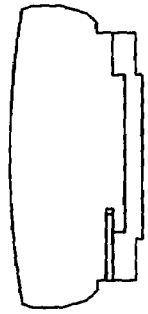
FIG. 25E
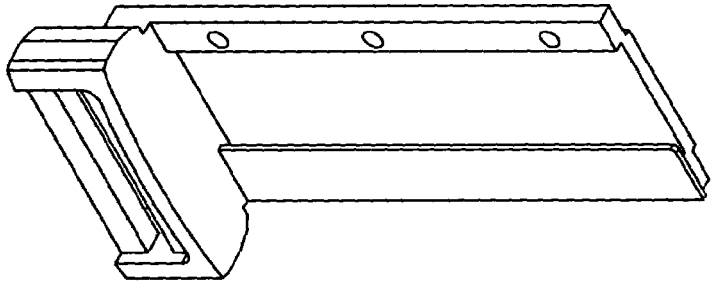
FIG. 25A
FIG. 25

LOCKABLE LUGGAGE STRAP ASSEMBLY

RELATED APPLICATIONS

This application is related to U.S. Provisional Patent Application Ser. No. 60/775,612, filed Feb. 22, 2006, entitled LOCKABLE LUGGAGE STRAP ASSEMBLY.

TECHNICAL FIELD

This invention relates to padlocks and lock systems and, more particularly, to lock systems constructed to securely affix a luggage strap about a desired product.

BACKGROUND ART

Numerous padlock constructions have been developed and are widely employed by individuals to prevent unauthorized persons from gaining access to any particular item or area which has been closed and locked. Although many locks are constructed to be opened by a key, numerous combination lock constructions have been developed which are opened by knowledge of a particular combination.

One particular type of combination lock that has become very popular due to its ease and convenience of use is a combination lock which employs a plurality of rotatable independent dials, each of which forms one of the indicia, usually numerals or letters, which comprise the combination for releasing the lock. Typically, the combination lock has one mode or position in which the user is able to set or reset the desired combination sequence. Although locks of this general nature have been available for several decades, these prior art combination lock constructions suffer from common deficiencies which have not been successfully overcome.

Although many manufacturers have attempted to solve the problems associated with rotatable dial or combination locks, one principal difficulty and drawback these prior art constructions have been unable to overcome is a construction which assures the user that a preset combination will not be accidentally or inadvertently altered or changed, without the user's knowledge. In such instances when the known combination is unknowingly changed or altered without the user's knowledge, the entire combination lock is incapable of future use, since the user is typically unable to release the shackle from locked engagement with the housing.

In addition, although key operated locks do not suffer from the difficulty of having the combination changed or altered without the user's knowledge, users are frequently incapable of using key operated locks, due to the key being lost or misplaced. As a result, prior art key operated locks are also frequently discarded due to the user's inability to find a particular key for operating the lock.

Another common problem which has consistently plagued prior art constructions is the cost of construction for producing and assembling prior art padlocks, whether the padlock is key operated or combination operated. In order to attain a padlock which provides all of the features desired by consumers, prior art constructions typically incorporate numerous small components, each of which require expensive assembly procedures to produce the final product. As a result, these prior art lock constructions are expensive to produce, thereby reducing the ability of these locks to reach a broad base of consumers.

A still further difficulty, which has recently arisen and affects both combination locks and key operated locks, is a requirement that all secured locks must be broken by Customs officers, and/or inspection or security personnel in order to gain access to luggage which is deemed suspicious. Under new security regulations that is being implemented, all luggage must be scanned or inspected to prevent the transportation of potentially dangerous items or products which are deemed to be undesirable. In those instances when luggage is scanned and further visual inspection is required, the inspectors have the authority to open the luggage for visual inspection, including physically breaking any lock which may be on the luggage.

Consequently, with these new regulations presently implemented, all prior art lock systems which are incapable of being opened by inspectors and/or security personnel are subject to be physically broken, in order to gain access to any luggage which needs to be visually inspected. As a result, consumers will now be faced with the possibility that any lock system employed to protect the contents of a suitcase can be physically removed by security personnel, leaving the luggage completely unprotected during the remainder of the trip.

Typically, prior art locks are affixed to the zipper pulls of luggage in order to secure the luggage in a closed and locked configuration. However, many individuals desire to peripherally surround their luggage, or other products, with a strap which is able to securely hold the pivotable portions of the luggage, or other product, in a closed configuration.

Although the use of straps has increased over the years, most prior art strap constructions suffer from the inability to be securely locked. Typically, the ends of these prior art strap constructions are mounted together in a wide variety of constructions and configurations, but are not securely engaged in a manner which requires knowledge of the particular combination or possession of a key to open or disengage the ends from each other. As a result, these prior art constructions are unable to provide users with the security and assurance that these prior art strap constructions can be securely locked in a manner which would prevent unauthorized access to the luggage or other products.

Furthermore, virtually all prior art lockable luggage straps are incapable of satisfying the requirements presently being imposed by security personnel or airport inspectors. As a result, consumers avoid the use of straps when traveling on airlines, since inspectors are authorized to cut off the strap if access to the luggage is required.

Therefore, it is a principal object of the present invention to provide a lockable strap assembly for luggage or other products which incorporates both a key operated portion and a combination operated portion for securely locking and opening or unlocking the secured strap assembly.

Another object of the present invention is to provide a lockable luggage strap assembly having the characteristic features described above which can be quickly and easily securely affixed peripherally surrounding any desired luggage while also being quickly mounted in locked interengagement in order to prevent unauthorized access to the luggage.

Another object of the present invention is to provide a lockable luggage strap assembly having the characteristic features described above which is capable of satisfying all requirements of security authorities for enabling authorized security personnel to disengage a locked strap assembly and, upon completion of inspection, quickly returned the strap assembly to its securely locked configuration.

Other and more specific objects will in part be obvious and will in part appear hereinafter.

SUMMARY OF THE INVENTION

By employing the present invention, all of the difficulties and drawbacks of prior art constructions are virtually eliminated and an effective, easily produced, lockable luggage strap assembly is achieved which incorporates two separate and independent locking systems formed in a single assembly. In accordance with the present invention, both locking systems independently enable the mating components thereof to be released and/or lockingly engaged by employing either a key controlled portion or a combination controlled portion.

In this way, by employing the combination controlled portion of the lockable luggage strap assembly of the present invention, any individual is able to preset a personalized combination and employ that personalized combination whenever desired to release the ends of the securely locked strap assembly. In addition, by employing the key controlled portion of the lockable luggage strap assembly of the present invention, a user or authorized third-party, such as security personnel, is able to release the engageable ends of the strap assembly from locked interengagement, whenever desired or required.

In the preferred embodiment of the present invention, a single housing is employed in which all of the required components are contained, with the housing being securely affixed to one end of an elongated, continuous strap member. In addition, the opposed end of the strap is securely affixed to a slider member which is constructed for mating, sliding and locking interengagement with the housing. In this way, the slider member is securely lockingly interengaged with the housing in a manner which provides the desired secure, locked mounted engagement of the strap assembly with the luggage or any other desired product.

In addition, whenever desired, the housing is unlocked, using one of the locked controlling portions thereof, for disengaging the slider member from the housing and enabling the strap to be removed from the luggage or other product. In this way, a dual locking and releasing strap assembly is achieved which virtually eliminates all of the difficulties and drawbacks encountered with known prior art constructions.

In the preferred construction of the present invention, the housing incorporates rotatable, combination defining dials which control the axial movement of an elongated rod member mounted in the housing for controllably moving a pivotable arm into locked and unlocked interengagement with the slider member. In this way, the telescopic, longitudinal movement of the slider member relative to the housing is completely controlled by the rotatable, combination defining dials, enabling the locking and/or releasing of the slider relative to the housing to be achieved by employing the known combination.

In addition, the housing of the present invention also incorporates a key controlled locking portion which is constructed for directly controlling the movement of the pivotable arm between its two alternate positions for locking and unlocking interengagement with the slider member. In the preferred embodiment, the key controlled locking portion incorporates a tumbler and rotatable chamber lock assembly which is responsive to the cuts on a key for positioning the tumblers to be properly aligned for enabling the chamber to be rotatable, thereby controlling the movement of the slider member. As a result, the key controlled locking portion of the housing is able to be employed for securely locking and/or releasing the slider member relative to the housing.

By employing the dual locking mode system of the present invention, all of the difficulties and drawbacks found in prior art constructions are overcome. In the present invention, the user is able to employ either of the two separate and independent lock controlling portions of the housing for releasing the slider from locked engagement with the housing whenever desired.

Furthermore, by employing the present invention, all of the difficulties and drawbacks which travelers face under newly enacted regulations are completely overcome. As detailed above, recently enacted regulations empower customs officials, and/or other inspection and security personnel, to physically break or cut any securely locked strap on a suitcase in order to gain access to a suitcase which is believed to contain suspicious material. However, by employing the present invention, the possibility of having a locked strap assembly completely broken or cut by customs or security personnel is totally prevented.

By employing the dual locking luggage strap assembly of the present invention, which comprises a combination controlled section and a key controlled section, a master key is created which is able to open the key controlled section of the dual mode lockable luggage strap assembly. As a result, in the event that a customs officer or security personnel requires a particular piece of luggage to be opened for further visual inspection, the customs officer or security personnel is able to open the dual locking luggage strap assembly by employing the Master key, which is provided to all such individuals. In this way, physically breaking or cutting the strap is totally eliminated and, once the visual inspection has been completed, the dual locking luggage strap assembly is replaced on the luggage and locked in position, in order to assure that the contents remain secured throughout the remainder of the trip.

In accordance with the present invention, a minimum number of components are employed in combination with the housing and the slider assembly in order to provide the desired unique, dual-mode lockable luggage strap assembly of the present invention. In this way, a highly effective and reasonably priced construction is achieved. Furthermore, the present invention achieves the lockable luggage strap assembly using a minimum number of independent components, each of which are capable of being quickly assembled into the final product. As a result, a construction is realized which is capable of being manufactured at competitive prices, while providing a high quality, highly effective dual mode lockable luggage strap assembly which virtually eliminates any degradation due to exposure to environmental contamination or long-term use.

The invention accordingly comprises an article of manufacture possessing the features, properties, and the relation of elements which will be exemplified in the article hereinafter described, and the scope of the invention will be indicated in the claims.

THE DRAWINGS

For a fuller understanding of the nature and objects of the invention, reference should be had to the following detailed description taken in connection with the accompanying drawings, in which:

FIG. 22 represents a series of views depicting the upper cover portion of the housing member of the dual-mode lockable luggage strap assembly of the present invention, wherein FIG. 22A is a top plan view thereof, FIG. 22B is a side elevation view thereof, and FIG. 22C is a bottom plan view thereof;

FIG. 23 represents a series of views depicting the lower body portion of the housing member of the dual-mode lockable luggage strap assembly of the present invention, wherein 23A is a perspective view thereof, FIG. 23B is a top plan view thereof, FIG. 23C is a side elevation view thereof and FIG. 23D is an end view thereof;

Figures 24, 24A, 24B, 24C, 24D, 24E, 24F:
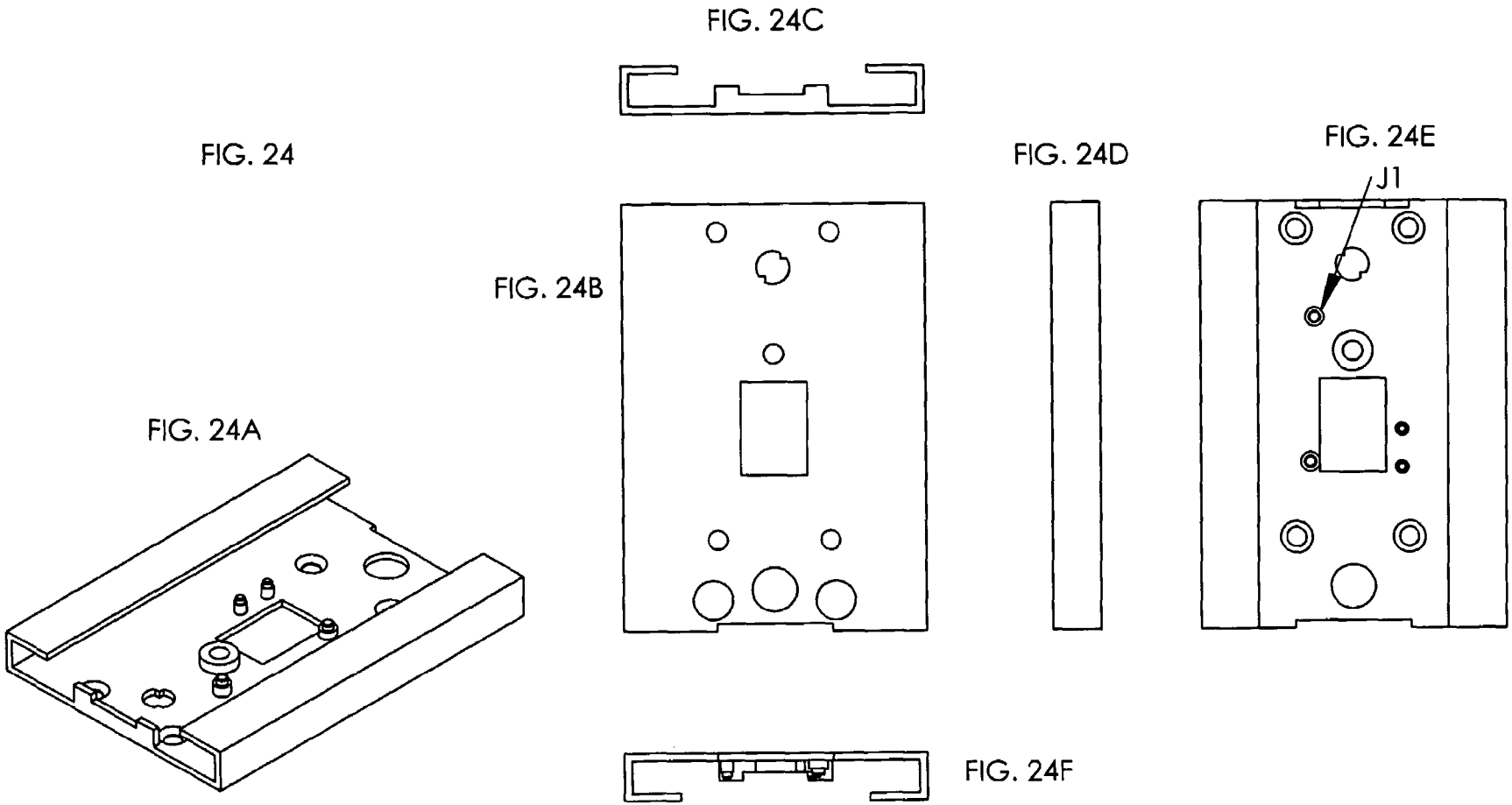

FIG. 24 represents a series of views depicting the sliding plate receiving member of the housing member of the dual-mode lockable luggage strap assembly of the present invention, wherein 24A is a perspective view thereof, FIG. 24B is a bottom plan view thereof, FIG. 24C is an end view thereof, FIG. 24D is a side elevation view thereof, FIG. 24E is a top plan view thereof, and FIG. 24F is an end view thereof; and FIG. 25 represents a series of views depicting the slide member forming a component of the dual-mode lockable luggage strap assembly of the present invention, wherein 25A is a perspective view thereof, FIG. 25B is a top plan view thereof, FIG. 25C is a side elevation view thereof, FIG. 25D is a bottom plan view thereof, and FIG. 25E is an end view thereof.

DETAILED DISCLOSURE

By referring to FIGS. 1-25, along with the following detailed discussion, the construction and operation of the preferred embodiment of the dual mode lockable luggage strap assembly of the present invention can best be understood. In the drawings and in the following detailed disclosure, the preferred embodiment of the present invention is fully detailed. However, this disclosure is provided for exemplary purposes only and, since the present invention can be implemented using alternate constructions, it is intended that these alternate constructions are within the scope of the present invention.

As depicted in FIGS. 1-25, the preferred embodiment of the dual mode lockable luggage strap assembly 20 of the present invention comprises housing member 21, slider member 22, and strap 24. A shown throughout the drawings, strap 24 incorporates end 25 and 26, and is constructed with end 25 securely affixed to slider member 22, while end 26 is securely affixed to housing member 21. In this way, when slider member 22 is in secure, locked engagement with housing member 21, strap 24 is able to peripherally surround the luggage, or other product, maintaining the luggage in the desired closed and locked position.

As detailed herein, the dual mode lockable luggage strap assembly of the present invention employs a minimum number of principal components, thereby substantially reducing the complexity found in most prior art padlocks. By employing the construction of the present invention, a highly effective, commercially desirable, dual-mode, lockable luggage strap assembly is realized which is capable of being produced at a competitive cost, while also providing the unique attributes of the present invention, along with all of the locking and theft deterrent features typically incorporated in prior art constructions.

As best seen in FIGS. 1-4, the dual-mode lockable luggage strap assembly 20 of the present invention incorporates housing member 21 in which combination controlled locking section 28 is contained, along with key controlled locking section 29. All of the components required for forming and operating combination controlled locking section 28, as well as the components required for forming and operating key controlled locking section 29 are fully detailed below. However, as detailed herein, regardless of the section used by an individual to lock and unlock dual-mode lockable luggage strap assembly 20 of the present invention, the cooperative locking interengagement and release of slider member 22 with housing member 21 is achieved.

In the preferred embodiment of the present invention elongated ratchet plate 30 is mounted to slider member 22, and incorporates a plurality of slanted teeth 31. Furthermore, housing member 21 incorporates spring biased pivot plate 32 on which tooth engaging locking finger 33 is formed. In this way, and as is more fully detailed below, slider member 22 is lockingly engaged with housing member 21 whenever locking finger 33 of pivot plate 32 is engaged with one of the teeth 31 of slider member 22. In addition, slider member 22 is controllably released from locked engagement with housing member 21 whenever locking finger 33 is removed from engagement within one of the teeth 31 of ratchet plate 30 by employing one of the locking sections of dual-mode lockable luggage strap assembly 20.

By employing one of the two locking sections formed in housing member 21, locking finger 33 of pivot plate 32 is capable of being controllably disengaged from teeth 31 of ratchet plate 30 of slider member 22. By employing combination controlled locking section 28 and inputting the correct, pre-set combination code, control knob 35 is released and is able to be rotated about its central axis. As is more fully detailed below, this rotational movement causes pivot plate 32 to articulately pivot, removing locking finger 33 from teeth 31 of ratchet plate 30.

Similarly, by employing key controlled locking section 29, the arcuate pivoting movement of the cylinder formed therein causes cam plate 76 to arcuately pivot, interacting with arm 90 and pivot plate 32 and forcing pivot plate 32 to disengage locking finger 33 from teeth 31. In this way, as more fully detailed below, the user or any authorized third-party is able to controllably disengage slider member 22 from housing member 21 whenever desired, while still being able to quickly and easily re-engage these components in locked interengagement when appropriate.

By referring to FIGS. 1-24, along with the following detailed discussion, the construction and operation of housing member 21 and slider member 22 of dual-mode lockable luggage strap assembly 20 of the present invention can best be understood. As depicted, in the preferred embodiment, housing member 21 incorporates a plurality of rotatable dials 40 and a plurality of cooperating clutch wheels 41. In the preferred embodiment as depicted, three separate and independent rotatable dials 40 and three separate and independent clutch wheels or sleeves 41 are employed. However, if desired, additional dials and clutch wheels can be used.

In addition, housing member 21 incorporates axially movable, elongated spindle 42 mounted therein which forms an integral component of combination locking section 28, along with rotatable dials 40 and clutch wheels 41. In this regard, as depicted, spindle 42 is mounted in housing member 21 for longitudinal, axial movement therein. Furthermore, rotatable dials 40 and clutch wheels 41 are mounted peripherally surrounding spindle 42, in cooperating association therewith. By mounting rotatable dials 40 and clutch wheels 41 in cooperating paired association, with each pair peripherally surrounding spindle 42, the axial movement of spindle 42 is controlled and limited to being movable only when dials 40 are set with the pre-defined combination.

Furthermore, spindle 42 is constructed to block the movement of control knob 35 whenever dials 40 do not display the preset combination, while also enabling control knob 35 to be arcuately rotated whenever dials 40 contain the preset combination. In this way, as more fully detailed below, combination controlled locking section 28 is capable of maintaining slider member 22 in locked interengagement with housing member 21 whenever desired, while also enabling the release of slider member 22 from housing member 21 when the preset combination has been properly employed.

In the preferred construction of the present invention, spindle 42 comprises a generally cylindrically shaped, elongated rod 43 incorporating an arcuately curved, rounded end 44 and a substantially rectangular or square shaped collar 45, spaced inwardly from rounded end 44. In the preferred construction, rectangular or square shaped collar 45 is constructed for enabling spindle 42 to longitudinally move within housing member 21, while being incapable of rotating about its central axis.

Finally, spindle 42 incorporates upstanding post members 46 which radially extend outwardly from rod 43 in juxtaposed, spaced, cooperating aligned relationship with each other, extending longitudinally along rod 43. In this regard, open zones 47 are formed between post members 46, defined by the spaced distance between post members 46.

Each clutch wheel 41 preferably comprises a generally hollow cylindrical shaped member 49 incorporating terminating end wall 50. In addition, end wall 50 incorporates keyhole shaped aperture 51 formed therein, which is defined by circular shaped portion 52 and rectangular shaped portion 53. Finally, each clutch wheel 41 incorporates a plurality of upstanding wall members 54 formed on the outer surface of cylindrically shaped member 49, with open zones 55 formed therebetween.

In this embodiment, each rotatable dial 40 is preferably constructed in a generally cylindrical, wheel shape, dimensioned for peripherally surrounding and cooperating with one clutch wheel 41. In this regard, each dial 40 comprises a circular shaped inside surface 57 and a cooperating, circular shaped outside surface 58. Inside surface 57 comprises a diameter slightly greater than the diameter of the outside surface of clutch wheel 41 in order to enable clutch wheel 41 and dial 40 to cooperate with each other while being independently rotationally movable about rod 43 of spindle 42.

In addition, each rotatable dial 40 incorporates a plurality of locking wedges 59 radially extending inwardly from inside surface 57 and dimensioned for cooperating interengagement in open zones 55 of clutch wheel 41. By employing the proper spaced dimensions, locking wedges 59 are movably mountable into open zones 55 of clutch wheel 41 in cooperating interengagement with upstanding wall members 54. In this way, the rotational movement of dials 40 about spindle 42 typically causes the associated clutch wheel 41 to arcuately rotate therewith.

Furthermore, each dial 40 comprises a plurality of slots 60 formed in outside surface 58 in order to define a plurality of panels 61. In addition, each panel 61 incorporates separate and distinct indicia formed therein, with the indicia being employable for designating a desired combination. Although any desired indicia can be employed and any desired number of panels 61 may be formed on wheel 40, in the preferred embodiment, ten separate and distinct panels 61 are formed on outside surface 58, with numerals being used as the indicia.

In this regard, one numeral ranging from 0, 1, 2, 3, 4, 5, 6, 7, 8, and 9 is preferably formed on each panel 61 of each rotatable dial 40. In this way, the user is able to employ any particular numeral on each rotatable dial 44 in creating a unique preset combination.

As shown in FIGS. 1-4, when dual-mode lockable luggage strap assembly 20 is fully assembled and is in the locked position, spindle 42 is mounted in housing member 21 with rounded end 44 thereof maintained in biased interengagement with control knob 35, due to the biasing forces exerted by spring 65. In addition, as is fully detailed below, rotational movement of control knob assembly 35 about its central axis is controllably limited by spindle 42.

In this regard, due to the construction of control knob assembly 35, the rotational movement of control knob assembly 35 forces spindle 42 to axially move within housing member 21 against the biasing forces of spring 65. However, due to the construction of combination controlling locking section 28, spindle 42 is only able to axially move when rotatable dials 40 display the desired preset combination.

In order for spindle 42 to axially move within housing member 21, upstanding post members 46 of spindle 42 must be aligned with rectangular portions 53 of keyhole shaped apertures 51 of clutch wheels 41. However, whenever the rectangular portion 53 of keyhole shaped aperture 51 of clutch wheels 41 are not perfectly aligned with each of the post members 46 of spindle 42, axial movement of spindle 42 is prevented.

In addition, due the construction and cooperative interengagement of clutch wheels 41 and rotatable dials 40, rectangular portions 53 of keyhole shaped apertures 51 of clutch wheels 41 is only placed in the precisely desired aligned position when each rotatable dial 40 has been moved to display the preselected indicia. In this way, dual-mode lockable luggage strap assembly 20 is only able to be unlocked using the combination controlled locking section in response to the user aligning rotatable dials 40 in the precisely desired location.

Once dials 40 have been placed in the precisely desired position, spindle 42 is able to be axially moved in housing member 21. In order to achieve this axial movement, control knob assembly 35 is employed. By referring to FIGS. 20 and 21, along with the following detailed discussion, the preferred construction of control knob assembly 35 can best be understood.

In this regard, control knob assembly 35 comprises an elongated shaft 70 having a notched zone 71 formed at one end thereof and a notched zone 72 formed at the opposed end thereof. In addition, radially extending flange 73 is mounted adjacent notched zone 72. In the preferred embodiment, a locking post 74 is mounted to shaft 70 directly adjacent flange 73, with post 74 radially extending outwardly therefrom. Although a wide variety of alternate constructions can be employed, it has been found that radially extending post 74 is preferably constructed as a separate component which is mounted within a post receiving aperture formed in shaft 70. However, any other desired construction can be employed with equal efficacy.

The two principal components mounted to shaft 70 forming control knob assembly 35 are collar 75 and cam plate 76. In the preferred embodiment, cam plate 76 comprises a generally flat, circular disc shape incorporating camming surface 77 formed therein. In addition, cam plate 76 is mounted to notched zone 72 of shaft 70 in a manner which assures that cam plate 76 is rotated simultaneously with any rotation of shaft 70.

In the preferred construction of collar 75, collar 75 incorporates abutment wall 80 formed in the outer surface thereof which cooperates with curved wall member 81. In addition, camming wall 82 radially extends outwardly from curved wall 81, terminating with a second curved wall 83 which has a diameter greater than curved wall 81. Finally, end wall 84 is formed as a stop for curved wall 83.

In addition, collar 75 incorporates a keyhole shaped central aperture 85 formed therein, which comprises a diameter for enabling collar 75 to be mounted to shaft 70 in abutting contact with flange 73. In addition, the notch portion of keyhole shaped aperture 85 is dimensioned for cooperating interengagement with post 74, in order to assure that any rotational movement of shaft 70 simultaneously causes collar 75 to rotate therewith. Finally, flanged knob 86 is mounted to notched zone 71 of shaft 74 providing an easily usable and readily accessible control element for arcuately pivoting control knob assembly 35 between its two alternate positions.

Figure 1:
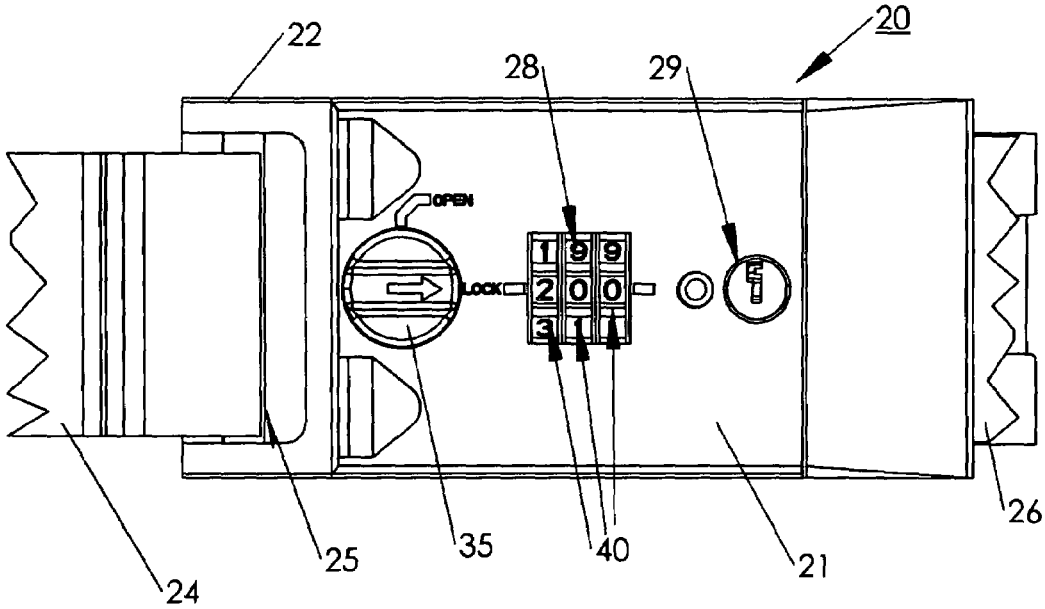
FIG. 1 is a top plan view, partially broken away, of the dual mode lockable luggage strap assembly of the present invention shown in the fully engaged and locked position.
Figure 2:
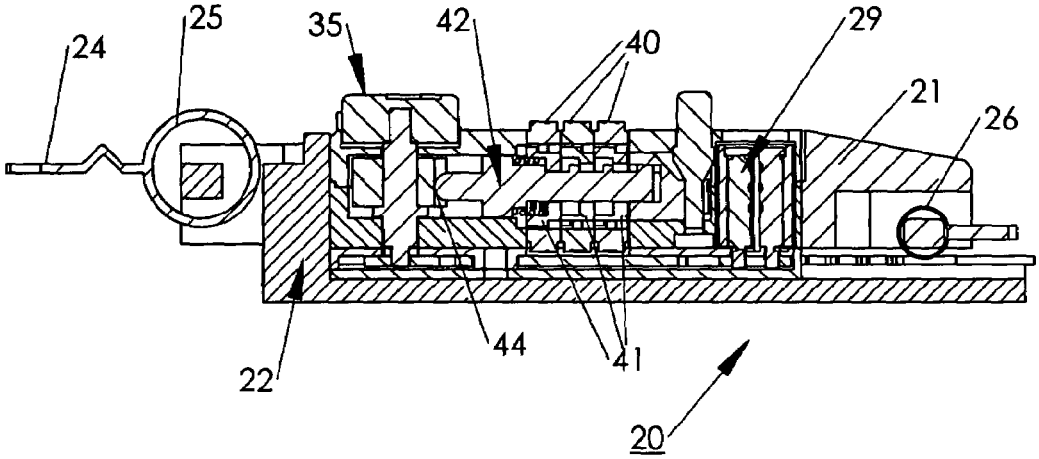
FIG. 2 is a cross-sectional side elevation view of the dual mode lockable luggage strap assembly of FIG. 1.
Figure 3:
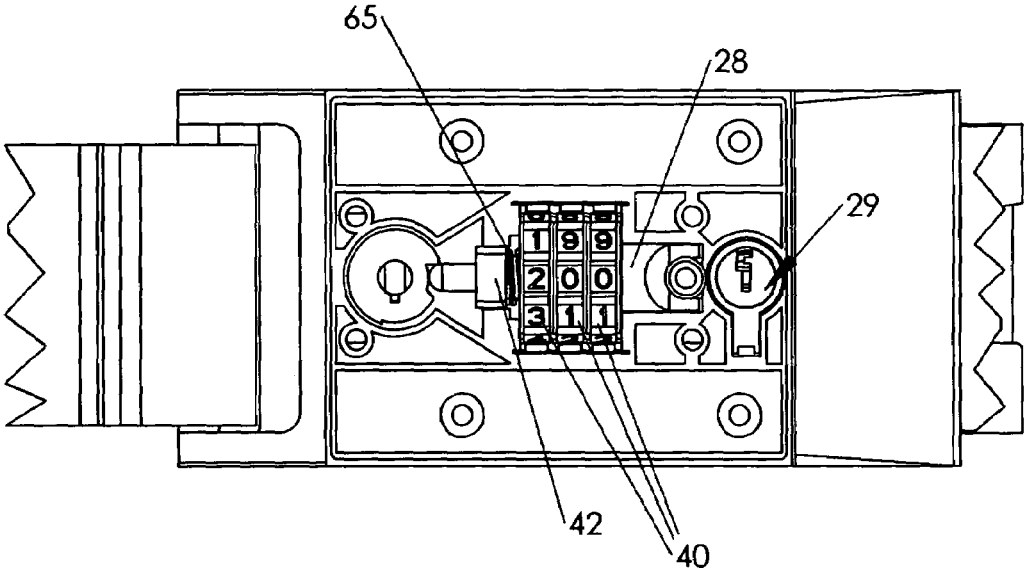
FIG. 3 is a top plan view of the dual mode lockable luggage strap assembly of the present invention with a cover element removed.
Figure 4:
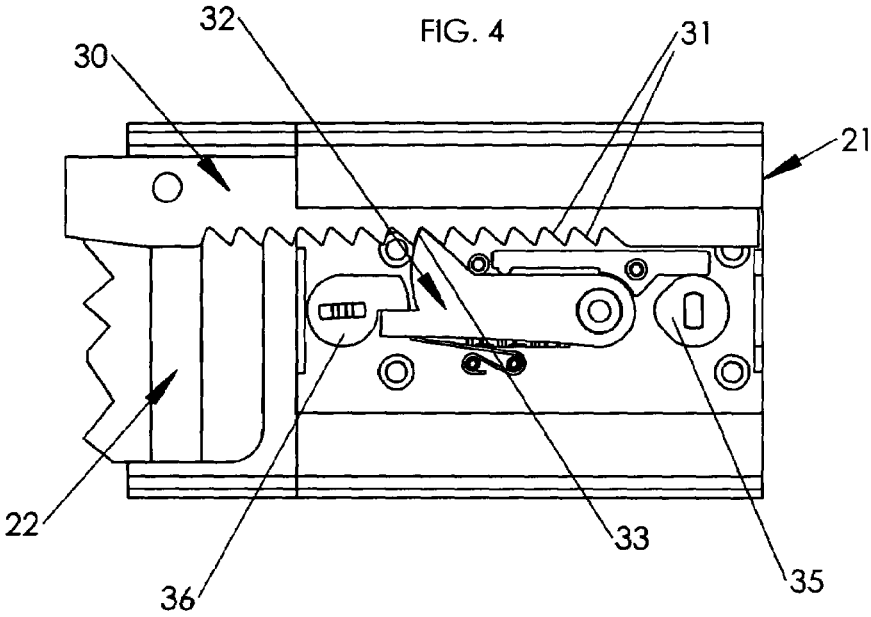
FIG. 4 is a bottom plan view of the dual-mode lockable luggage strap assembly of FIG. 1 with the cover element removed to show the internal components thereof.
Figure 5:
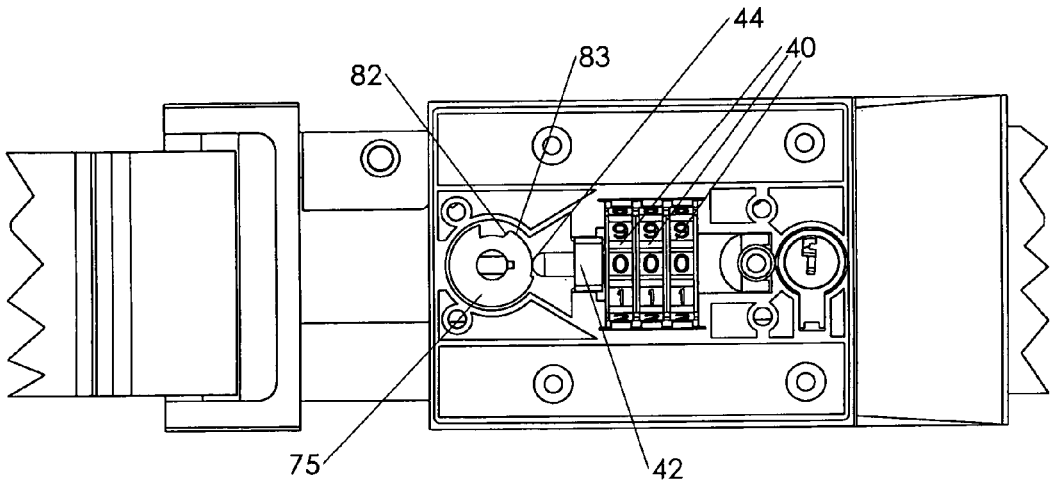
FIG. 5 is a top plan view of the dual-mode lockable luggage strap assembly of FIG. 1 shown with the top cover removed and in the unlocked and partially disengaged configuration.
Figure 6:
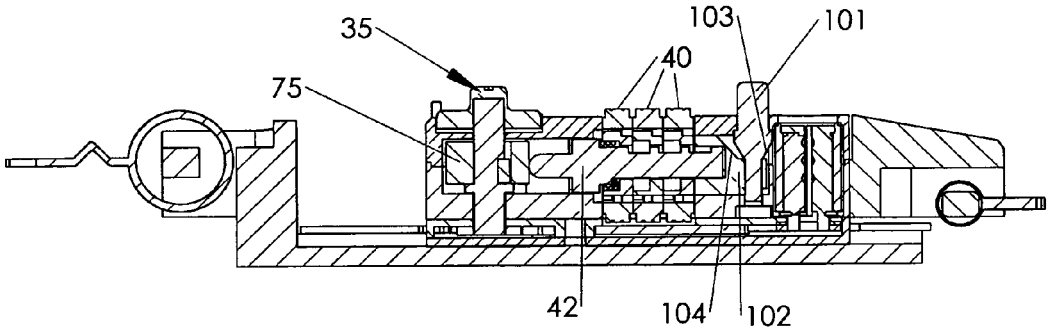
FIG. 6 is a cross-sectional side elevation view of the dual-mode lockable luggage strap assembly of FIG. 5.
Figure 7:
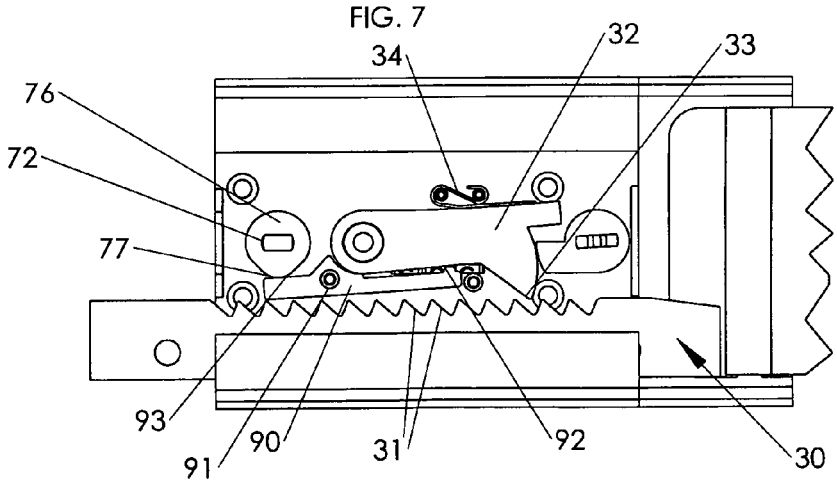
FIG. 7 is a bottom plan view of the dual-mode lockable luggage strap assembly of FIG. 6 with the cover element removed to show the internal components thereof.
Figure 8:
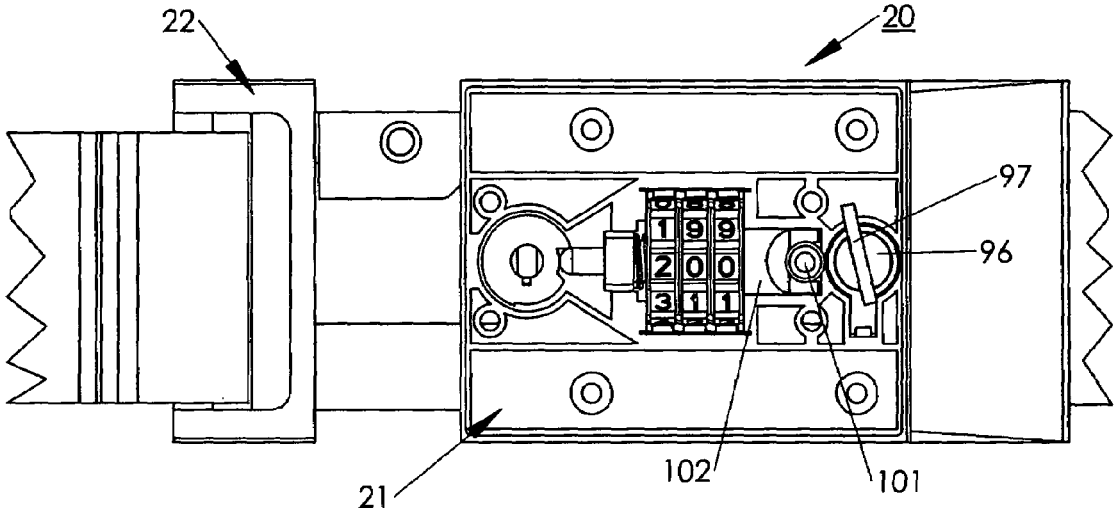
FIG. 8 is a top plan view of the dual-mode lockable luggage strap assembly of the present invention with the top cover removed and with the assembly in the key operated unlocked configuration.
Figure 9:
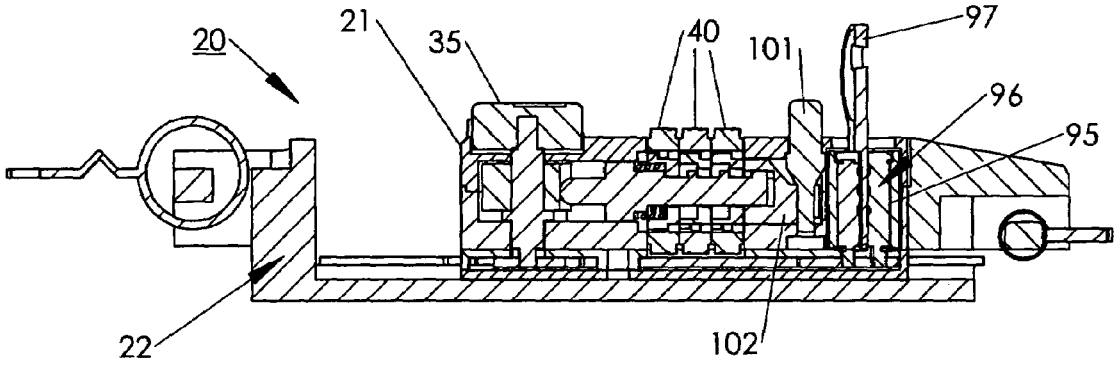
FIG. 9 is a cross-sectional side elevation view of the dual-mode lockable luggage strap assembly of FIG. 8.

As is evident from the foregoing detailed discussion, along with the additional disclosure contained herein, and shown in FIGS. 5-7, the rotational movement of control knob assembly 35 directly controls the axial movement of spindle 42 in housing member 21. However, as detailed above, this rotational movement is only capable of being achieved when rotatable dials 40 display the preset combination.

In this regard, once rotatable dials 40 have been set with the desired preset combination, spindle 42 is capable of being axially moved within housing member 21. As a result, whenever control knob assembly 35 is rotated, curved wall member 81 is free to slidingly engage with rounded end 44 of rod 43 of spindle 42, until camming wall 82 is brought into contact with rounded end 44. When rounded end 44 of spindle 42 contacts camming wall 82 of collar 75, camming wall 82 forces spindle 42 to axially move within housing member 21 in a direction away from control knob assembly 35. This axial movement brings rounded end 44 of spindle 42 into contact with second curved wall 83. The rotational movement of control knob assembly 35 is allowed to continue until terminating end wall 84 contacts spindle 42.

The rotational movement of control knob assembly 35 causes cam plate 76 to simultaneously rotate therewith bringing camming surface 77 into contact with control arm 90. As best seen in FIG. 7, control arm 90 is mounted in cooperating relationship with pivot plate 32 with control arm 90 incorporating a pivot axis 91. In addition, control arm 90 incorporates a first end portion 92 and a second end portion 93. As depicted, control arm 90 is capable of arcuately pivoting about pivot axis 91 with first end portion 92 controllably engaging pivot plate 32 and second end portion 93 being controllably engaged with cam plate 76.

By employing this construction, the arcuate rotational movement of control knob assembly 35 causes cam plate 76 to rotate therewith, bringing outwardly extending camming surface 77 of cam plate 76 into engagement with second end portion 93 of control arm 90. This camming movement of cam plate 76 forces control arm 90 to arcuately pivot, causing a first end portion 92 to contact pivot plate 32, which forces pivot plate 32 to remove locking finger 33 from engagement with teeth 31 of ratchet plate 30. As a result, slider member 22 is unlocked and able to be disengaged from housing member 21.

In addition to employing combination controlling locking section 28 for opening dual-mode lockable luggage strap assembly 20, the present invention also incorporates key controlled locking section 29 formed as an integral part of housing number 21 for enabling luggage strap assembly 20 to be unlocked in a separate and independent alternate manner. By referring to FIGS. 8-10, along with the following detailed discussion, the construction and operation of this key controlling locking and unlocking mode can best be understood.

In the preferred construction, key control locking section 29 incorporates elongated bore 95 formed in housing member 21 extending from the top surface thereof to the bottom surface. In addition, cylinder assembly 96 is mounted in elongated bore 95 and constructed for being arcuately pivoted relative to housing member 21 whenever key 97 is inserted in cylinder assembly 96. Although various constructions can be employed, the use of two separate cylinders is preferred, with one cylinder being rotationally movable relative to the outer cylinder. In this way, the desired arcuate rotational movement is achieved in response to the insertion of the appropriately designed key 97.

In order to enable key control locking section 29 of housing number 21 to directly control the disengagement of slider member 22 from housing 21, the insertion of key 97 in cylinder assembly 96 must enable the disengagement of locking finger 33 of pivot plate 32 from teeth 31 of ratchet plate 30. In this regard, in order to achieve this required result, controlling latch plate 36 is mounted to the bottom surface of cylinder assembly 96, in a manner which causes latch plate 36 to rotate simultaneously with the rotation of cylinder assembly 96 whenever key 97 is inserted therein and rotated.

Figure 10:
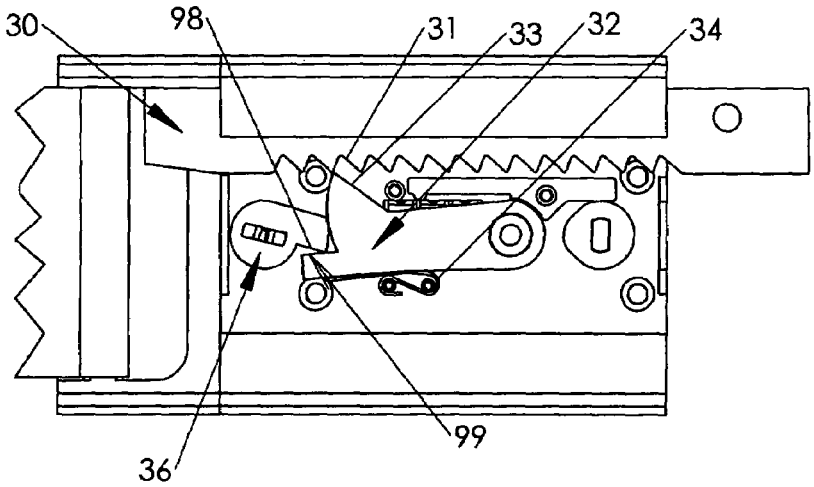
FIG. 10 is a bottom plan view of the dual-mode lockable luggage strap assembly of FIG. 8 with the cover element removed to show the internal components thereof.
Figure 11:
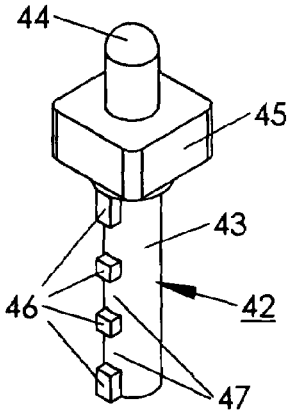
FIGS. 11-13 are a series of views showing the spindle member incorporated into the dual-mode lockable luggage strap assembly of the present invention.
Figure 12:
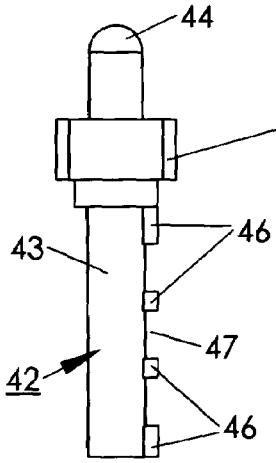
Figure 13:
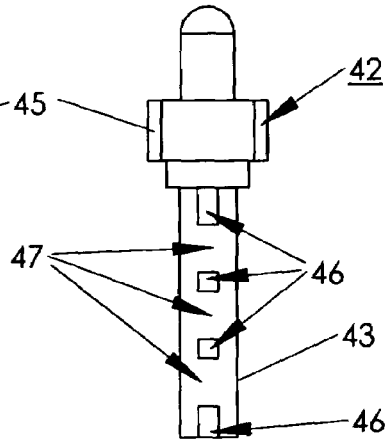
Figure 14:
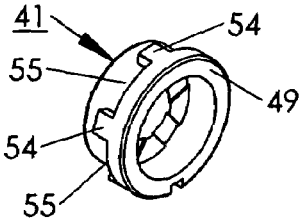
FIGS. 14-16 are a series of views depicting the clutch wheel incorporated into the dual-mode lockable luggage strap assembly of the present invention.
Figure 15:
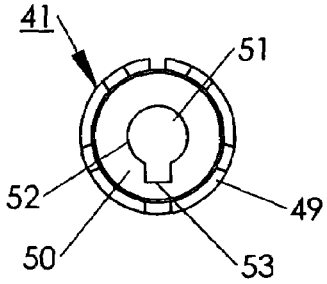
Figure 16:
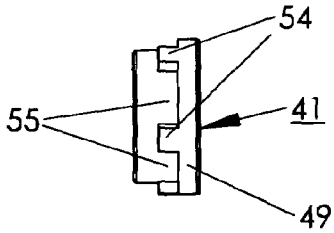
Figure 17:
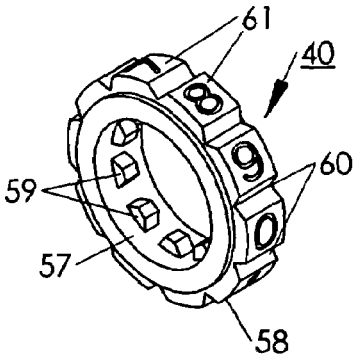
FIGS. 17-19 are a series of views depicting the rotatable dial incorporated into the dual-mode lockable luggage strap assembly of the present invention.
Figure 18:
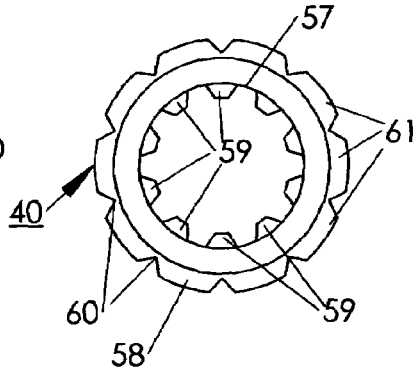
Figure 19:
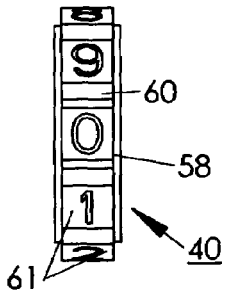
Figure 20:
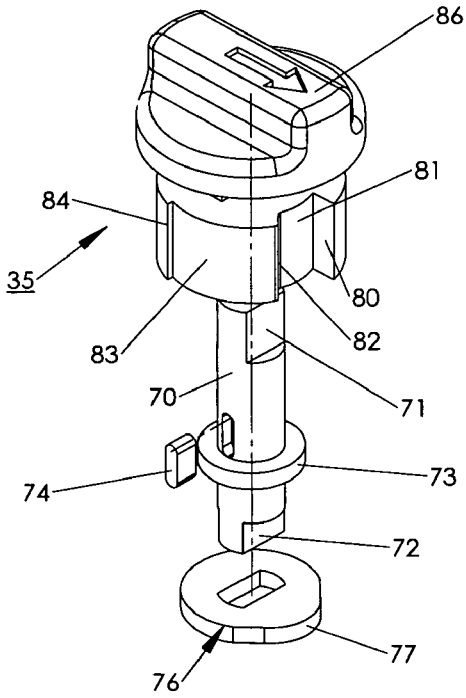
FIGS. 20 and 21 are exploded perspective views of the control knob assembly incorporated into the dual-mode lockable luggage strap assembly of the present invention.
Figure 21:
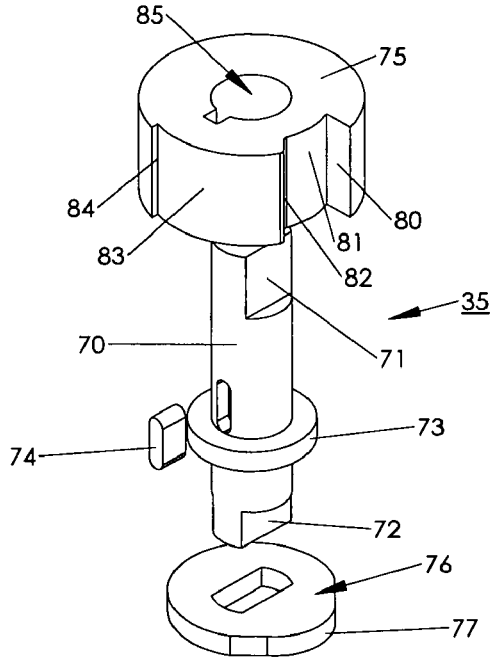

As best seen in FIG. 10, controlling latch plate 36 is securely mounted to the base of cylinder assembly 96 for being rotated therewith, whenever cylinder assembly 96 is rotated by the use of key 97. In this regard, controlling latch plate 36 incorporates radially extending finger 98 which is positioned for controlling contact with flange 99 of pivot plate 32. As a result, whenever latch plate 36 is rotated, finger 98 thereof engages flange 99 of pivot plate 32, causing pivot plate 32 to arcuately pivot about its pivot axis. This arcuate movement causes locking finger 33 of pivot plate 32 to be removed from interengagement with teeth 31 of ratchet plate 30, thereby enabling slider member 22 to be released from locked engagement with housing member 21.

In addition, as depicted, the preferred construction incorporates a biasing spring 34 which is cooperatively associated with pivot plate 32 in order to continuously bias pivot plate 32 into engagement with teeth 31 of ratchet plate 30. As a result, whenever the disengaging forces are removed from pivot plate 32, pivot plate 32 automatically returns to its original position, either engaging with teeth 31 of ratchet plate 30 or being positioned for engaging with teeth 31 of ratchet plate 30 whenever slider member 22 is inserted therein.

As is evident from the foregoing detailed discussion and the construction of the components as detailed herein, slider member 22, once removed from housing number 21, can be quickly and easily returned into locked interengagement with housing member 21 by merely inserting and advancing slider member 22 into housing member 21. In this regard, since teeth 31 of ratchet plate 30 comprise sloping edges, slider member 22 is able to be advanced in one direction into housing member 21, while being incapable of being moved from housing member 21 in the opposed direction. As a result, the desired secure locked interengagement of slider member 22 with housing number 21 is quickly and easily achieved.

In order to enable dual mode lockable luggage strap assembly 20 to be used in the desired manner, combination controlling locking section 28 must be constructed in a manner which enables the user to set any desired combination on rotatable dials 40. In this regard, combination controlling locking section 28 incorporates post 101 which is constructed for cooperating with slider 102. Post 101 incorporates ramp sloping surface 103 which is constructed for cooperating with ramp sloping surface 104 of slider 102.

In operation, a user rotates dials 40 to be in the desired existing combination, and then presses post 101 causing slider 102 to advance towards control knob assembly 35. This movement of slider 102 forces clutch wheels 41 to become disengaged from rotatable dials 40, thereby enabling rotatable dials 40 to be easily positioned into any desired location with a particular indicia formed thereon being displayed. Once each rotatable dial 40 displays the particular indicia desired by the user, the holding forces are removed from post 101, causing slider 102 and clutch wheels 41 to return to their original position. In this way, any desired combination can be quickly and easily set on dials 40.

In order to provide a full and complete disclosure of the present invention, in addition to the foregoing to a detailed discussion, FIGS. 22-25 have been provided. In each of these figures, a plurality of alternate views of the various components forming housing member 21 and slider member 22 are fully depicted. In FIG. 22, which consists of FIGS. 22A, 22B, and 22C, the upper portion of housing number 21 is fully detailed, while FIG. 23, which consists of FIGS. 23A, 23B, 23C, and 23D, fully depicts the bottom portion of housing member 21. The assembly of housing member 21 is completed by incorporating a slider receiving plate member fully depicted in FIG. 24, which consists of FIGS. 24A, 24B, 24C, 24D, 24E, and 24F. Finally, FIG. 25 incorporates a plurality of alternate views fully detailing the construction of slider member 22.

It will thus be seen that the object set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described our invention, what we claim is new and desire to secure by Letters Patent is:

1. A dual mode lockable luggage strap system comprising:

A. a belt or strap member constructed for peripherally surrounding any desired suitcase or package for maintaining the suitcase/package in a closed configuration;

B. a housing securely affixed to a first end of the belt/strap member and incorporating a first key controlled locking section and a second combination controlled locking section, with both of said locking sections being constructed for controlling the movement of a pivotable locking plate mounted therein;

C. a slider member affixed to a second end of the belt/strap member and constructed for longitudinal, sliding interengagement with the housing and incorporating an engaging member a) constructed for cooperative interengagement with the locking plate of the housing for securely engaging the locking plate of the housing and being maintained in locked interengagement there with, unless released by the activation of either the first key controlled locking section or the second combination controlled locking section of the housing, and b) comprising an elongated, longitudinally extending flange formed along the slider member and incorporating a plurality of ratchet teeth formed therein and D. the pivotable locking plate mounted to the housing and comprising an elongated substantially flat member incorporating a ratchet tooth engaging finger constructed for being biasingly maintained in position for continuously engaging one of said ratchet teeth unless acted upon by an opposing force, and a) incorporating a first side edge and a second, opposed side edge extending from a first end to a second, opposed end, b) mounted at the first end thereof to a surface of the housing for enabling the locking plate to pivot relative to the surface of the housing, c) cooperatively associated with biasing means mounted to the surface of the housing and positioned for contacting and continuously biasing the first side edge of the locking plate in a first direction, and d) incorporating the ratchet tooth engaging finger formed along the second side edge of the plate, and constructed for being continuously biased in the first direction for engagement in one of the ratchet teeth formed in the flange of the slider member;

whereby a dual mode lockable luggage strap system is attained which is capable of quickly and easily being securely affixed to any desired suitcase or package in completely locked mode, while also being capable of being easily unlocked by activation of either the key controlled locking section or the combination controlled locking section thereof.

2. The dual mode lockable luggage strap system defined in claim 1, wherein the movement of said pivotal locking plate for disengaging the ratchet tooth engaging finger thereof is independently controlled by the activation of one selected from the group consisting of the key controlled locking section and the combination controlled locking section.

3. The dual mode lockable luggage strap system defined in claim 2, wherein the first key control locking section is further defined as comprising a cylinder assembly mounted in the housing and constructed for rotational movement in the housing in response to the insertion of an activating key therein, and a control plate mounted to the cylinder assembly for arcuate pivoting movement simultaneously therewith, with said control plate being positioned for controlling engagement with the locking plate of the housing for causing the locking plate of the housing to arcuately pivot in response to the rotation of the cylinder assembly, whereby the rotational movement of the cylinder assembly simultaneously causes the locking plate to be disengaged from the ratchet teeth of the slider member.

4. The dual mode lockable luggage strap system defined in claim 3, wherein the pivotal locking plate is further defined as comprising a flange member longitudinally extending from the second end thereof and positioned for cooperating, controlled interengagement with the control plate of the cylinder assembly, whereby movement of the control plate causes the pivotal locking plate to simultaneously move therewith.

5. The dual mode lockable luggage strap system defined in claim 2, wherein the second combination controlled locking section is further defined as comprising:

1) an elongated spindle member mounted in the housing for controlled axial movement therein,
2) a plurality of rotatable dials with each dial cooperatively associated with a tumbler sleeve, with each of the dials and tumbler sleeves being constructed for controlling the axial movement of the spindle member, and allowing axial movement only when each rotatable dial is placed in a desired position,
3) an elongated control knob assembly mounted in the housing and constructed for rotational movement about its central axis, with a portion of the control knob assembly being engaged with a first end portion of the elongated spindle member, whereby rotational movement of the control knob assembly causes the axial movement of the elongated spindle member when the dials are properly positioned, and
4) a locking plate movement control assembly constructed for causing the locking plate to become disengaged from the ratchet teeth of the slider member in response to the rotational movement of the control knob assembly.

6. The dual mode lockable luggage strap system defined in claim 5, wherein the spindle member is further defined as being spring biased for maintaining the first end portion of the spindle member in contact with a movement controlling collar forming a part of the control knob assembly, with the collar incorporating camming surfaces for controllably moving the spindle member axially in response to the position of the dials and tumbler sleeves cooperatively associated with the spindle member.

7. The dual mode lockable luggage strap system defined in claim 6, wherein the control knob assembly further comprises a cam plate mounted thereto and positioned for controlling the movement of the locking plate movement control assembly, whereby rotational movement of the control knob assembly causes the cam plate to contact the locking plate movement control assembly for causing the locking plate to become disengaged from the ratchet teeth of the slider member.

8. The dual mode lockable luggage strap system defined in claim 7, wherein the locking plate movement control assembly is further defined as comprising an arm member pivotally mounted in the housing in association with the locking plate, with a first end of the arm member positioned in contact with the second side edge of the locking plate and a second end of the arm member positioned in contact with the cam plate of the control knob assembly, whereby rotational movement of the control knob assembly and the associated rotational movement of the cam plate causes the arm member to pivot for moving the locking plate out of engagement with the ratchet teeth of the slider member.

9. The dual mode lockable luggage strap system defined in claim 6, wherein each of the rotatable dials incorporate indicia formed on the outer surface thereof for enabling a plurality of alternate positions to be easily designated.

10. The dual mode lockable luggage strap system defined in claim 9, wherein said indicia is further defined as comprising one selected from the group consisting of numerals, letters, alphanumeric designations, colors and pictures.

11. The dual mode lockable luggage strap system defined in claim 5, wherein the spindle member is further defined as being constructed for axial, longitudinal movement in the housing, while being incapable of rotational movement therein.

12. The dual mode lockable luggage strap system defined in claim 5, wherein the control knob assembly is further defined as comprising an upstanding readily accessible flange member formed on one end of the control knob assembly and positioned for providing ready access to a user for causing said control knob assembly to rotate when desired by the user.

13. The dual mode lockable luggage strap system defined in claim 2, wherein a spring biased, ratchet tooth engaging finger formed on the locking plate of the housing and the ratchet teeth formed in the elongated, longitudinally extending flange of the slider member are constructed for providing axial, sliding movement of the slider member in a first direction while preventing axial, sliding movement of the slider member in the opposite direction.

14. The dual mode lockable luggage strap system defined in claim 1, wherein said belt/strap member comprises a continuous length of tough, damage resistant and cut-resistant material enabling the suitcase/package to be fully protected.

* * * * *